US005354648A

United States Patent [19]

Bucci et al.

[11] Patent Number: 5,354,648

[45] Date of Patent: Oct. 11, 1994

[54] RADIOGRAPHIC ASSEMBLY HAVING REDUCED IMAGE-WISE CROSS-OVER AND SUPER RAPID PROCESSABILITY

[75] Inventors: Marco Bucci, Genoa; Renzo Torterolo, Bragno/Cairo Montenotte; Pierfiore Malfatto, Montenotte/Ferrania; Marco Beruto, Savona, all of Italy

[73] Assignee: Minnesota Mining and Manufacturing Company, St. Paul, Minn.

[21] Appl. No.: 73,184

[22] Filed: Jun. 7, 1993

[30] Foreign Application Priority Data

Jul. 2, 1992 [IT] Italy ..... MI92A001620

[51] Int. Cl.[5] ..... G03C 1/46

[52] U.S. Cl. ..... 430/502; 430/139; 430/539; 430/963; 430/966; 430/967; 430/622; 430/509; 430/621

[58] Field of Search ..... 430/502, 139, 539, 963, 430/966, 967, 622, 509, 621

[56] References Cited

U.S. PATENT DOCUMENTS

| | | | |
|---|---|---|---|
| 4,173,481 | 11/1979 | Sera et al. | 430/622 |
| 4,414,304 | 11/1983 | Dickerson | 430/502 |
| 4,425,425 | 1/1984 | Abbott et al. | 430/502 |
| 4,847,189 | 7/1989 | Suzuki et al. | 430/502 |
| 4,994,355 | 2/1991 | Dickerson et al. | 430/509 |
| 4,997,750 | 5/1991 | Dickerson et al. | 430/509 |
| 5,021,327 | 6/1991 | Bunch et al. | 430/502 |
| 5,108,881 | 4/1992 | Dickerson et al. | 430/502 |
| 5,187,259 | 2/1993 | Sterman et al. | 430/539 |

FOREIGN PATENT DOCUMENTS

| | | |
|---|---|---|
| 0126644A2 | 5/1984 | European Pat. Off. . |
| 0366418 | 5/1990 | European Pat. Off. . |
| 0382058 | 8/1990 | European Pat. Off. . |
| 0457153 | 11/1991 | European Pat. Off. . |
| 1103973 | 7/1954 | France . |
| 2009433 | 6/1979 | United Kingdom . |

OTHER PUBLICATIONS

Research Disclosure Dec. 1973—Disclosed anonymously (R2574) 11619; (R2575) 11620; (R2584) 11629.

*Primary Examiner*—Thomas R. Neville

*Attorney, Agent, or Firm*—Gary L. Griswold; Walter N. Kirn; Mark A. Litman

[57] ABSTRACT

A radiographic assembly comprising:

a radiographic element which comprises a support and a front and back pair of silver halide emulsion layers coated on the opposite sides of the support, and a front and back pair of intensifying screens adjacent said front and back emulsion layers, respectively, wherein at least one of said silver halide emulsion layers shows a swelling index lower than 140% and a melting time of from 45 to 120 minutes, and the contrast difference between said pair of silver halide emulsion layers is at least 0.5, wherein the X-ray stimulated light emission difference between said pair of intensifying screens is at least 0.6 IogE, and wherein the average imagewise cross-over of said radiographic element is lower than 5% at optical density of from 0.5 to 1.75 and in the range of from 5 to 15% at optical density of from 1.75 to 3.25, said imagewise cross-over being measured according to the formula described in the specificaton.

19 Claims, No Drawings

RADIOGRAPHIC ASSEMBLY HAVING REDUCED IMAGE-WISE CROSS-OVER AND SUPER RAPID PROCESSABILITY

FIELD OF THE INVENTION

This invention relates to a radiographic assembly. More specifically, the invention relates to a radiographic assembly comprising a duplitized silver halide radiographic element and a pair of intensifying screens.

BACKGROUND OF THE ART

It is known in the art of medical radiography to employ intensifying screens to reduce the X-ray dosage to the patient. Intensifying screens absorb the X-ray radiation and emit electromagnetic radiations which can be better absorbed by silver halide emulsion layers. Another approach to reduce the X-ray dosage to the patient is to coat two silver halide emulsion layers on the opposite sides of a support to form a duplitized radiographic element.

Accordingly, it is a common practice in medical radiography to use a radiographic assembly consisting of a duplitized radiographic element interposed between a pair of front and back screens.

A well known problem of this assembly relates to the cross-over phenomenon. Cross-over is due to light emitted from a screen which passes through the transparent film support and exposes the opposite silver halide emulsion layer. The result is a reduced sharpness of the resulting image due to light scattering caused by the support.

Many solutions have been suggested to reduce the cross-over problem, as disclosed for example, in Research Disclosure, August 1979, Item 18431, Section V, "Crossover Exposure Control". Research Disclosure is a publication of Kenneth Mason Publication Ltd., Erosworth, Hampshire PO10 7DD, United Kingdom.

The major part of the suggested solutions relates to the use of a filter substance absorbing the crossing light, as disclosed, for example, in Research Disclosure Vol. 122, June 1974, Item 12233, GB 1,426,277, GB 1,414,456, GB 1,477,638, GB 1,477,639, U.S. Pat. No. 3,849,658, U.S. Pat. Nos. 4,803,150, 4,997,750, and 4,994,355. The use of the above solution causes some other problems, such as, for example, efficiency reduction of the assembly, desensitization of the silver halide emulsion, worsening of the tint and/or tone of the developed radiographic element, longer developing time to eliminate the filter substance, and the like.

Other approaches relate to the use of reflecting underlayers or polarizing underlayers. Tabular silver halide grains are also known for their use to reduce cross-over, as disclosed in U.S. Pat. Nos. 4,425,425 and 4,425,426. These patents disclose that a reduction of cross-over is directly proportional with the increase of the aspect ratio, and the best results are obtained with tabular grains having an aspect ratio higher than 8:1.

In medical radiography another problem is related to the different X-ray absorption of the various parts of the body. For example, in chest radiography the heart area has an absorption ten times higher than the lung area. A similar effect occurs in the radiography of the stomach, where a contrast medium is used in order to enhance the image depictivity (the body part having no contrast medium being totally black), and of hands and legs, where bones have an X-ray absorption higher than that of soft tissues such as flesh and cartilage.

In these cases a radiographic element showing a low contrast is required for area of high X-ray absorption and a radiographic element showing a high contrast is required for area of low X-ray absorption. The resulting film is a compromise in an attempt to have sufficient optical density and sharpness for these different areas of the body. However, if the areas of low X-ray absorption are correctly exposed, the areas of high X-ray absorption are not correctly visible due to underexposure. On the other hand, if the areas of high X-ray absorption are correctly exposed, the other areas are totally black due to overexposure. Various methods have been suggested to solve this problem. One approach relates to the use of radiographic elements having two different emulsion layers coated on each side of the support. An example of this solution can be found in French patent 1,103,973, wherein the use of screens having a light emission ratio of from 1:1 to 1.5:1 (back screen:front screen) in combination with a radiographic element having coated thereon a high contrast back emulsion and a low contrast front emulsion is suggested. A combination of screens having a light emission ratio higher than 1.5:1 and radiographic elements having emulsion layers with the same gradation is also suggested. Other patents disclose the use of double coated radiographic elements having emulsion layers with different contrast or sensitivity. For example, DE 1,017,464 discloses a double coated radiographic element having coated thereon a first emulsion with high sensitivity and low contrast and a second emulsion with low sensitivity and high contrast, FR 885,707 discloses a double coated radiographic element having coated thereon a first high speed emulsion and a second high contrast emulsion, and FR 875,269 discloses a radiographic assembly comprising several radiographic films or papers, each having a different sensitivity and/or contrast relative to the others, in order to obtain separate and different images of the same object with a single exposure. Nothing in the above described patents suggested the use of the specific combination of the present invention to obtain a double-coated radiographic element showing a reduced cross-over, a super-rapid processability and optimal image quality. An approach similar to that of the above described French and German patents is disclosed in U.S. Pat. No. 4,994,355, claiming a double coated radiographic element having emulsion layers with different contrast, in U.S. Pat. No. 4,997,750, claiming a double coated radiographic element having emulsion layers with different sensitivity and in U.S. Pat. No. 5,021,327 claiming a radiographic assembly wherein the back screen and emulsion layer have a photicity at least twice that of the front screen and emulsion layer, the photicity being defined as the integrated product of screen emission and emulsion sensitivity. As discussed above, these patents require the use of a dye underlayer to reduce cross-over and moreover require a processing time of at least 90 seconds. Research Disclosure, December 1973, Vol. 116, Item 11620 discloses a radiographic element which shows different contrast when observed with or without a green filter, respectively. Finally, EP 126,644 disclosed a double coated radiographic element having silver halide emulsion layers with different contrast at different ranges of optical density.

A third more recent problem in medical radiography relates to the increased use of silver halide elements, which has led to a strong request for a reduction of processing times. If rapid processing of a film (i.e., a process shorter than 45 seconds) takes place, several problems can occur, such as an inadequate image density (i.e., insufficient sensitivity, contrast and maximum density), insufficient fixing, insufficient washing, and insufficient film drying. Insufficient fixing and washing of a film cause a progressive worsening of the image quality and modification of the silver tone. Moreover, the high temperature and the low gelatin content used for the reduction of the processing time cause the radiographic element to be marked by the pressure of the transporting roller. The use of hardening agents to foreharden the silver halide radiographic element has been suggested, for example, in U.S. Pat. No. 4,414,304 but satisfactory results have not yet been obtained.

Accordingly, there is still the need of a radiographic assembly which solves the above mentioned problems.

SUMMARY OF THE INVENTION

A radiographic assembly comprising:

a radiographic element which comprises a support and a front and back silver halide emulsion layers coated on the opposite sides of the support, and a front and back pair of intensifying screens adjacent said front and back emulsion layers, respectively, wherein at least one of said silver halide emulsion layers show a swelling index lower than 140% and a melting time of from 45 to 120 minutes, and the contrast difference between said pair of silver halide emulsion layers is at least 0.5, wherein the X-ray stimulated light emission difference between said pair of intensifying screens is at least 0.6 IogE, and wherein the average imagewise cross-over of said radiographic element is lower than 5% at optical density of from 0.5 to 1.75 and in the range of from 5 to 15% at optical density of from 1.75 to 3.25, said imagewise cross-over being measured according to the formula:

$$A = \left(\left(\left(\frac{XF}{B+XF}\right)\left(\frac{B}{S}\right)\right)+\left(\left(\frac{XB}{F+XB}\right)\left(\frac{F}{S}\right)\right)\right) * 100$$

wherein A is the imagewise cross-over percentage, B is the optical density of the back silver halide emulsion layer, F is the optical density of the front silver halide emulsion layer, XB is the optical density due to cross-over from the back side on the front side, XF is the optical density due to cross-over from the front side on the back side, and S is the sum of B+F+XB+XF.

DETAILED DESCRIPTION OF THE INVENTION

A radiographic assembly comprising:

a radiographic element which comprises a support and a front and back pair of silver halide emulsion layers coated on the opposite sides of the support, and a front and back pair of intensifying screens adjacent said front and back emulsion layers, respectively, wherein at least one of said silver halide emulsion layers shows a swelling index lower than 140% and a melting time of from 45 to 120 minutes, and the contrast difference between said pair of silver halide emulsion layers is at least 0.5 unit, wherein the X-ray stimulated light emission difference between said pair of intensifying screens is at least 0.6 IogE, and wherein the average imagewise cross-over of said radiographic element is lower than 5% at optical density of from 0.5 to 1.75 and in the range of from 5 to 15% at optical density of from 1.75 to 3.25, said imagewise cross-over being measured according to the following formula:

$$A = \left(\left(\left(\frac{XF}{B+XF}\right)\left(\frac{B}{S}\right)\right)+\left(\left(\frac{XB}{F+XB}\right)\left(\frac{F}{S}\right)\right)\right) * 100$$

wherein A is the imagewise cross-over percentage, B is the optical density of the back silver halide emulsion layer, F is the optical density of the front silver halide emulsion layer, XB is the optical density due to cross-over from the back side on the front side, XF is the optical density due to cross-over from the front side on the back side, and S is the sum of B+F+XB+XF.

As employed herein "swelling index" refers to the percent swell obtained by (a) conditioning the radiographic element at 38° C. for 3 days at 50% relative humidity, (b) measuring the layer thickness, (c) immersing the radiographic element in distilled water at 21° C. for 3 minutes, and (d) determining the percent change in layer thickness as compared to the layer thickness measured in step (b). The swelling index is represented by the following formula:

$$SW \cdot IND = \frac{TH_d - TH_b}{TH_b} * 100$$

wherein $TH_d$ and $TH_b$ are respectively the thickness measured at step (d) and (b). In a preferred embodiment of the present invention both the front and back silver halide emulsion layers coated on the opposite sides of the support show a swelling index lower than 140%.

As employed herein the term "melting time" refers to the time from dipping into an aqueous solution of 1.5% by weight of NaOH at 50° C. a silver halide radiographic element cut into a size of 1×2 cm until at least one of the silver halide emulsion layers constituting the silver halide radiographic element starts to melt. Reference to this method can also be found in U.S. Pat. No. 4,847,189. In a preferred embodiment of the present invention, both the front and back silver halide emulsion layers coated on the opposite sides of the support show a melting time of from 45 to 120 minutes.

In the present invention, a silver halide radiographic element comprising at least one silver halide emulsion layer, preferably both the front and back silver halide emulsion layers, showing the above mentioned value of melting time and swelling index can be processed in a super-rapid processing of less than 45 seconds, preferably of less than 30 seconds from the insertion of the radiographic lo element in an automatic processor to the exit therefrom, using a hardener free developer and fixer. In these conditions the physical and photographic characteristics of the radiographic element of the present invention can be equal to or better than the physical and photographic characteristics obtained with rapid processing of from 45 to 90 seconds.

On the other hand, the specific combination of characteristics of the present invention can provide a radiographic element which does not require any means to reduce cross-over interposed between the support and said silver halide emulsion layers. The physical and photographic characteristics are not affected by the absence of said cross-over reducing means. On the contrary, the absence of means to reduce cross-over, such as, for example, dispersed dyes as disclosed in U.S. Pat. Nos. 4,803,150, 4,900,652, 4,994,355 and 4,997,750, together with the other characteristics of the present invention may provide a radiographic element having a total processing time lower than 45 seconds without affecting the tint and tone of the developed element. The sensitometric characteristics of the present invention, in particular sharpness, are not affected by the absence of cross-over reducing means, due to the imagewise cross-over effect of the present invention.

The imagewise cross-over effect of the present invention is measured, for each optical density, according to the following formula:

$$A = \left(\left(\left(\frac{XF}{B+XF}\right)\left(\frac{B}{S}\right)\right)+\left(\left(\frac{XB}{F+XB}\right)\left(\frac{F}{S}\right)\right)\right) * 100$$

wherein A is the imagewise cross-over percentage, B is the optical density of the back silver halide emulsion layer, F is the optical density of the front silver halide emulsion layer, XB is the optical density due to cross-over from the back side on the front side, XF is the optical density due to cross-over from the front side on the back side, and S is the sum of B+F+XB+XF.

The average imagewise cross-over is obtained by calculating the mathematical average of the cross-over values taken at 0.25 unit intervals between the optical density values of from 0.5 and 1.75 and of from 1.75 and 3.25, respectively. According to the present invention, the average imagewise cross-over is lower than 5%, preferably lower than 3% at optical density of from 0.5 to 1.75 and in the range of from 5 to 15%, preferably of from 5 to 10%, at optical density of from 1.75 to 3.25. The higher value of cross-over at higher optical densities does not affect the image quality of the radiographic element.

In fact, at lower optical density a very low cross-over is observed, and tissues having a high X-ray absorption can be correctly exposed without any loss of sharpness and contrast. On the other hand, at high optical density, where a higher cross-over is observed, the higher value of contrast allows the system to expose tissue having a low X-ray absorption without any image defects. This is a strong improvement versus the known prior art, which has never disclosed a multipurpose radiographic element able to be processed in a total processing time of less than 90 seconds.

The silver halide grains in the radiographic emulsion may be regular grain having a regular crystal structure such as cube, octahedron, and tetradecahedron, or the spherical or irregular crystal structure, or those having crystal defects such as twin plane, or those having a tabular form, or the combination thereof.

The term "cubic grains" according to the present invention is intended to include substantially cubic grains, that is silver halide grains which are regular cubic grains bounded by crystallographic faces (100), or which may have rounded edges and/or vertices or small faces (111), or may even be nearly spherical when prepared in the presence of soluble iodides or strong ripening agents, such as ammonia. The silver halide grains may be of any required composition for forming a negative silver image, such as silver chloride, silver bromide, silver iodide, silver chloro-bromide, silver bromo-iodide and the like. Particularly good results are obtained with silver bromo-iodide grains, preferably silver bromo-iodide grains containing about 0.1 to 15% moles of iodide ions, more preferably about 0.5 to 10% moles of iodide ions and still preferably silver bromo-iodide grains having average grain sizes in the range from 0.2 to 3 μm, more preferably from 0.4 to 1.5 μm. Preparation of silver halide emulsions comprising cubic silver halide grains is described, for example, in Research Disclosure, Vol. 184, Item 18431, Vol. 176, Item 17644 and Vol. 308, Item 308119.

Other silver halide emulsions according to this invention having highly desirable imaging characteristics are those which employ one or more light-sensitive tabular grain emulsions as disclosed in U.S. Pat. Nos. 4,425,425 and 4,425,426. The tabular silver halide grains contained in the silver halide emulsion layers of this invention have an average diameter:thickness ratio (often referred to in the art as aspect ratio) of at least 3:1, preferably 3:1 to 20: 1, more preferably 3:1 to 14:1, and most preferably 3:1 to 8:1. Average diameters of the tabular silver halide grains suitable for use in this invention range from about 0.3 μm to about 5 μm, preferably 0.5 μm to 3 μm, more preferably 0.8 μm to 1.5 μm. The tabular silver halide grains suitable for use in this invention have a thickness of less than 0.4 μm, preferably less than 0.3 μm and more preferably less than 0.2 μm.

The tabular silver halide grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter:thickness ratios obtained do not greatly differ.

In the silver halide emulsion layer containing tabular silver halide grains, at least 15%, preferably at least 25%, and, more preferably, at least 50% of the silver halide grains are tabular grains having an average diameter:thickness ratio of not less than 3:1. Each of the above proportions, "15%", "25%" and "50%" means the proportion of the total projected area of the tabular grains having a diameter:thickness ratio of at least 3:1 and a thickness lower than 0.4 μm, as compared to the projected area of all of the silver halide grains in the layer.

As described above, commonly employed halogen compositions of the silver halide grains can be used. Typical silver halides include silver chloride, silver bromide, silver iodide, silver chloroiodide, silver bromoiodide, silver chlorobromoiodide and the like. However, silver bromide and silver bromoiodide are preferred silver halide compositions for tabular silver halide grains with silver bromoiodide compositions containing from 0 to 10 mol % silver iodide, preferably from 0.2 to 5 mol % silver iodide, and more preferably from 0.5 to 1.5 mol % silver iodide. The halogen composition of individual grains may be homogeneous or heterogeneous.

Silver halide emulsions containing tabular silver halide grains can be prepared by various processes known for the preparation of radiographic elements. Silver halide emulsions can be prepared by the acid process, neutral process or ammonia process. In the stage for the preparation, a soluble silver salt and a halogen salt can be reacted in accordance with the single jet process, double jet process, reverse mixing process or a combination process by adjusting the conditions in the grain formation, such as pH, pAg, temperature, form and scale of the reaction vessel, and the reaction method. A silver halide solvent, such as ammonia, thioethers, thioureas, etc., may be used, if desired, for controlling grain size, form of the grains, particle size distribution of the grains, and the grain-growth rate.

Preparation of silver halide emulsions containing tabular silver halide grains is described, for example, in de Cugnac and Chateau, "Evolution of the Morphology of Silver Bromide Crystals During Physical Ripening", Science and Industries Photographiques, Vol. 33, No.2 (1962), pp.121–125, in Gutoff, "Nucleation and Growth Rates During the Precipitation of Silver Halide Photographic Emulsions", Photographic Science and Engineering, Vol. 14, No. 4 (1970), pp. 248–257,in Berry et al., "Effects of Environment on the Growth of Silver Bromide Microcrystals", Vol.5, No.6 (1961), pp. 332–336, in U.S. Pat. Nos. 4,063,951, 4,067,739, 4,184,878, 4,434,226, 4,414,310, 4,386,156, 4,414,306 and in EP Pat. Appln. No. 263,508.

The silver halide emulsions can be chemically and optically sensitized by known methods. The silver halide emulsion layers can contain other constituents generally used in photographic products, such as binders, hardeners, surfactants, speed-increasing agents, stabilizers, plasticizers, optical sensitizers, dyes, ultraviolet absorbers, etc., and reference to such constituents can be found, for example, in Research Disclosure, Vol. 176, Item 17644, Vol. 184, Item 18431 and Vol 308, Item 308119.

The radiographic element of this invention can be prepared by coating the light-sensitive silver halide emulsion layers and other auxiliary layers on a support. Examples of materials suitable for the preparation of the support include glass, paper, polyethylene-coated paper, metals, polymeric film such as cellulose nitrate, cellulose acetate, polystyrene, polyethylene terephthalate, polyethylene, polypropylene and other well known supports. Preferably, the silver halide emulsion layers are coated on the support at a total silver coverage of at least 1 $g/m^2$, preferably in the range of from 2 to 5 $g/m^2$.

As described above said front and back silver halide emulsion layers differ in average contrast by at least 0.5. It is preferred that the average contrasts of the front and back silver halide emulsion layers differ by at least 0.8.

The radiographic element according to the present invention is associated with the intensifying screens so as to be exposed to the radiations emitted by said screens. The screens are made of relatively thick phosphor layers which transform the x-rays into light radiation (e.g., visible light). The screens absorb a portion of x-rays much larger than the radiographic element and are used to reduce the radiation doses necessary to obtain a useful image. According to their chemical composition, the phosphors can emit radiations in the blue, green or red region of the visible spectrum and the silver halide emulsions are sensitized to the wavelength region of the light emitted by the screens. Sensitization is performed by using spectral sensitizers as well-known in the art. The x-ray intensifying screens used in the practice of the present invention are phosphor screens well-known in the art. Particularly useful phosphors are the rare earth oxysulfides doped to control the wavelength of the emitted light and their own efficiency. Preferably are lanthanum, gadolinium and lutetium oxysulfides doped with trivalent terbium as described in U.S. Pat. No. 3,725,704. Among these phosphors, the preferred ones are gadolinium oxysulfides wherein from about 0.005% to about 8% by weight of the gadolinium ions are substituted with trivalent terbium ions, which upon excitation by UV radiations, x-rays, or cathodic rays emit in the blue-green region of the spectrum with a main emission line around 544 nm. Other references to useful phosphors can be found in Research Disclosure Vol. 184, Item 18431, Section IX.

The X-ray stimulated light emission difference between said pair of intensifying screens is at least 0.6 IogE, preferably at least 0.9 IogE. In a preferred embodiment of the invention, the screen showing the higher light emission is used as back screen. However, good results are obtained also employing the screen showing the lower light emission as back screen.

Whatever the order of the screens may be, there are no limitations as far as the orientation of the silver halide radiographic element is concerned. This means that the high and low contrast silver halide emulsion layers can be used adjacent to the front screen or the back screen, indifferently. This is another strong improvement versus the known prior art disclosing asymmetrical radiographic elements which require a correct orientation, to avoid improper use. Human errors are completely avoided by the radiographic assembly of the present invention.

In other words, any of the constructions of the following scheme can be indifferently used:

| Front screen | Front emulsion | | Back emulsion | Back screen |
|---|---|---|---|---|
| LE | LC | // | HC | HE (1) |
| LE | HC | // | LC | HE (2) |
| HE | LC | // | HC | LE (3) |
| HE | HC | // | LC | LE (4) |

In the previous scheme, LE is a low emission screen, HE is a high emission screen, LC is a low contrast emulsion and HC is a high contrast emulsion. Assemblies 1 and 2 are, however, preferred to have a better image quality for tissues having a high X-ray absorption (e.g. bones).

In preparing the silver halide emulsions of the present invention, a wide variety of hydrophilic dispersing agents for the silver halides can be employed. Gelatin is preferred, although other colloidal materials such as gelatin derivatives, colloidal albumin, cellulose derivatives or synthetic hydrophilic polymers can be used as known in the art. Other hydrophilic materials useful known in the art are described, for example, in Research Disclosure, Vol. 308, Item 308119, Section IX. In a preferred aspect of the present invention highly deionized gelatin is used. The highly deionized gelatin is characterized by a higher deionization with respect to the commonly used photographic gelatins. Preferably, the gelatin for use in the present invention is almost completely deionized which is defined as meaning that it presents less than 50 ppm (parts per million) of $Ca^{++}$ ions and is practically free (less than 5 parts per million) of other ions such as chlorides, phosphates, sulfates and nitrates, compared with commonly used photographic gelatins having up to 5,000 ppm of $Ca^{++}$ ions and the significant presence of other ions.

The highly deionized gelatin can be employed not only in the silver halide emulsion layers, but also in other component layers of the radiographic element, such as overcoat layers, interlayers and layers positioned beneath the emulsion layers. In the present invention, preferably at least 50%, more preferably at least 70% of the total hydrophilic colloid of the radiographic element comprises highly deionized gelatin. The amount of gelatin employed in the radiographic element of the present invention is such as to provide a total silver to gelatin ratio higher than 1 (expressed as grams of Ag/grams of gelatin). In particular the silver to gelatin ratio of the silver halide emulsion layers is in the range of from 1 to 1.5.

The above mentioned values of swelling index and melting time can be satisfied by fore-hardening the radiographic element of the present invention with a gelatin hardener. Examples of gelatin hardeners are aldehyde hardeners, such as formaldehyde, glutaraldehyde and the like, active halogen hardeners, such as 2,4-dichloro-6-hydroxy-1,3,5-triazine, 2-chloro-4,6-hydroxy-1,3,5-triazine and the like, active vinyl hardeners, such as bisvinylsulfonyl-methane, 1,2-vinylsulfonylethane, bisvinylsulfonyl-methyl ether, 1,2-bisvinylsulfonyl-ethyl ether and the like, N-methylol hardeners, such as dimethylolurea, methyloldimethyl hydantoin and the like. Other useful gelatin hardeners may be found in Research Disclosure 308119, December 1989, Paragraph X. In a preferred embodiment of the present invention the gelatin hardener is a bi-,tri-, or tetra-vinylsulfonyl substituted organic hydroxy compound of formula $(CH_2{=}CH{-}SO_2{-})_n{-}A$, wherein A is an n-valent organic group containing at least one hydroxy group and n is 2,3 or 4.

In the above general formula, the group A represents an n-valent acyclic hydrocarbon group, a 5 or 6 membered heterocyclic group containing at least one nitrogen, oxygen or sulfur atom, a 5 or 6 membered alicyclic group or an aralkylene group having at least 7 carbon atoms. Each of these A groups may either have a substituent or combine with each other through a hetero atom, for example, a nitrogen, oxygen and/or sulfur atom, or a carbonyl or carbonamido group.

In the above general formula, the group A may be advantageously any organic divalent group, preferably an acyclic hydrocarbon group such as an alkylene group having 1 to 8 carbon atoms, e.g., a methylene group, an ethylene group, a trimethylene group, a tetramethylene group, etc., or an aralkylene group having a total of 8 to 10 carbon atoms. One to three of the carbon atoms of the group defined above for A can be replaced by a hetero atom such as a nitrogen atom, an oxygen atom, a sulfur atom, etc. Also, the group A can be additionally substituted, for example, with one or more alkoxy groups having 1 to 4 carbon atoms such as a methoxy group, an ethoxy group, etc., a halogen atom such as a chlorine atom, a bromine atom, etc., an acetoxy group and the like.

The above hydroxy substituted vinylsulfonyl hardeners can be prepared 35 using known methods, e.g., methods similar to those described in U.S. Pat. No. 4,173,481.

Examples of compounds represented by the above given formula are given below. However, it must be understood that the present invention is not limited thereto.

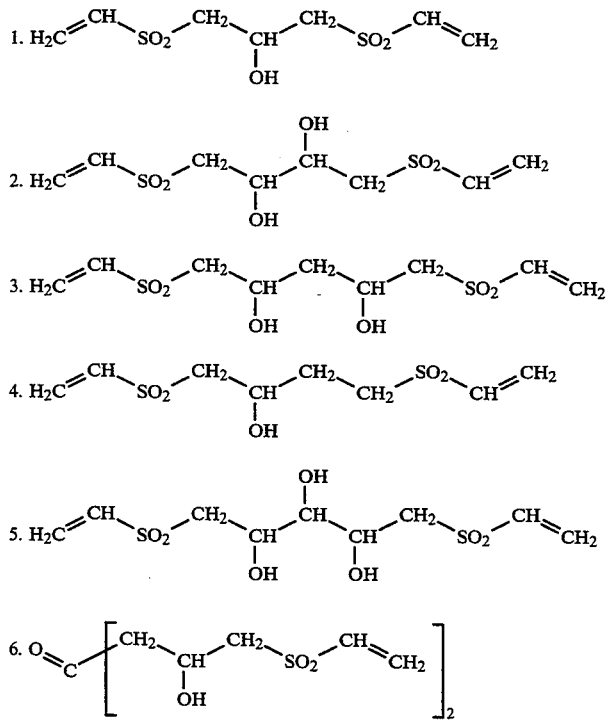

-continued
7. 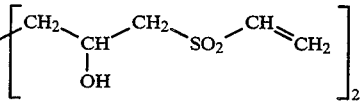
8. 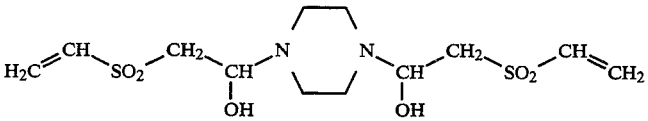
9. 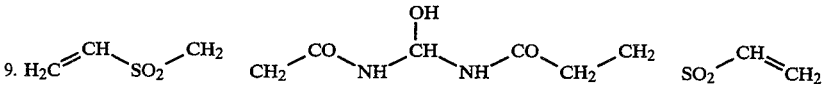
10. 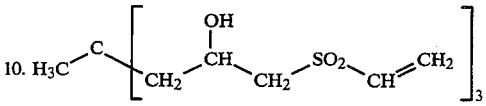
11. 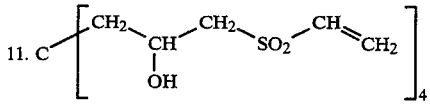
12. 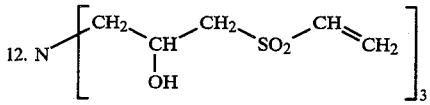
13. 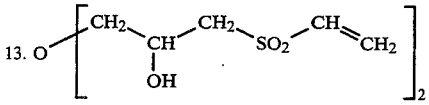
14. 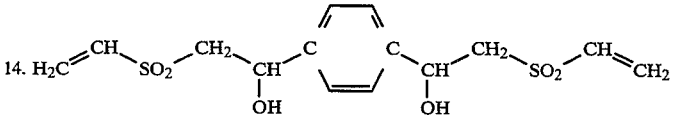
15. 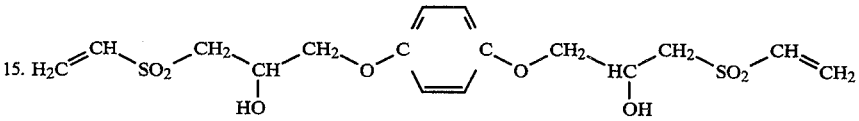
16. 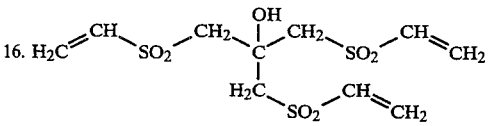
17. 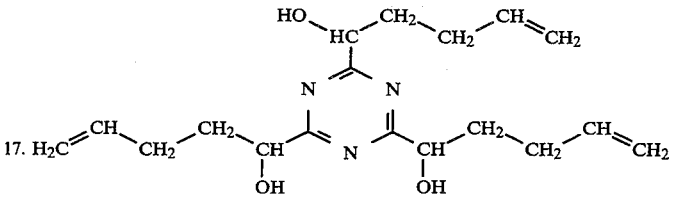
18. 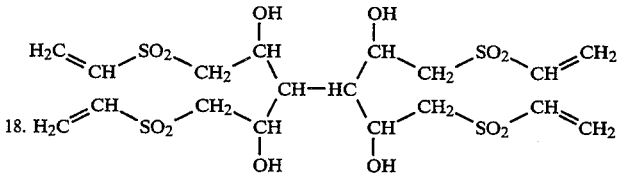

-continued

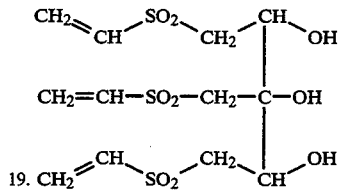

19.

The above described gelatin hardeners may be incorporated in the silver halide emulsion layer or in a layer of the silver halide radiographic element having a water-permeable relationship with the silver halide emulsion layer. Preferably, the gelatin hardeners are incorporated in the silver halide emulsion layer.

The amount of the above described gelatin hardener that is used in the silver halide emulsion of the radiographic element of this invention can be widely varied. Generally, the gelatin hardener is used in amounts of from 0.5% to 10% by weight of hydrophilic dispersing agent, such as the above described highly deionized gelatin, although a range of from 1% to 5% by weight of hydrophilic dispersing agent is preferred.

The values of swelling index and melting time according to the present invention can also be satisfied by using a mixture of the above-mentioned gelatin hardeners, provided that the effects of the invention are not destroyed.

The gelatin hardeners can be added to the silver halide emulsion layer or other components layers of the radiographic element utilizing any of the well-known techniques in emulsion making. For example, they can be dissolved in either water or a water-miscible solvent as methanol, ethanol, etc. and added into the coating composition for the above-mentioned silver halide emulsion layer or auxiliary layers.

In addition to the features specifically described above, the radiographic elements of this invention, in the silver halide emulsion layers or in other layers, can include additional addenda of conventional nature, such as stabilizers, antifoggants, brighteners, absorbing materials, hardeners, coating aids, plasticizers, lubricants, matting agents, antikinking agents, antistatic agents, and the like, as described in Research Disclosure, Item 17643, December 1978 and in Research Disclosure, Item 18431, August 1979.

As regards the processes for the silver halide emulsion preparation and the use of particular ingredients in the emulsion and in the light-sensitive element, reference is made to Research Disclosure 184, Item 18431, August 1979, wherein the following chapters are dealt with in deeper details:

IA. Preparation, purification and concentration methods for silver halide emulsions.
IB. Emulsion types.
IC. Crystal chemical sensitization and doping.
II. Stabilizers, antifogging and antifolding agents.
IIA. Stabilizers and/or antifoggants.
IIB. Stabilization of emulsions chemically sensitized with gold compounds.
IIC. Stabilization of emulsions containing polyalkylene oxides or plasticizers.
IID. Fog caused by metal contaminants.
IIE. Stabilization of materials comprising agents to increase the covering power.
IIF. Antifoggants for dichroic fog.
IIG. Antifoggants for hardeners and developers comprising hardeners.
IIH. Additions to minimize desensitization due to folding.
III. Antifoggants for emulsions coated on polyester bases.
IIJ. Methods to stabilize emulsions at safety lights.
IIK. Methods to stabilize x-ray materials used for high temperature. Rapid Access, roller processor transport pro-cessing.
III. Compounds and antistatic layers.
IV. Protective layers.
V. Direct positive materials.
VI. Materials for processing at room light.
VII. X-ray color materials.
VIII. Phosphors and intensifying screens.
IX. Spectral sensitization.
X. UV-sensitive materials
XII. Bases The exposed radiographic elements can be processed by any of the conventional processing techniques. Such processing techniques are illustrated for example in Research Disclosure, Item 17643, cited above. Roller transport processing is particularly preferred, as illustrated in U.S. Pat. Nos. 3,025,779; 3,515,556; 3,545,971 and 3,647,459 and in UK Patent 1,269,268.

This invention, in particular, is effective for high temperature, accelerated processing times of less than 45 seconds, preferably of less than 30 seconds, with automatic processors wherein the radiographic element is transported automatically and at constant speed from a processing unit to other by means of rollers. Generally, the first unit is the developing unit and preferably the developing bath is a hardener free developing bath. In a preferred embodiment a hardener free aqueous developing solution useful to develop the radiographic element of the present invention comprises:

(1) at least one black-and-white developing agent,
(2) at least one black-and-white auxiliary developing agent,
(3) at least one antifoggant,
(4) at least one sequestering agent,
(5) sulfite antioxidant, and
(6) at least one buffering agent.

The developing agents for silver halide radiographic elements suitable for the purposes of the present invention include hydroquinone and substituted hydroquinones (e.g. t-butylhydroquinone, methylhydroquinone, dimethylhydroquinone, chlorohydroquinone, dichlorohydroquinone, bromohydroquinone, 1,4-dihydroxynaphthalene, methoxyhydroquinone, ethoxyhydro-quinone, etc.). Hydroquinone, however, is preferred. Said silver halide developing agents are generally used in an amount from about 2 to 100 grams per liter, preferably 6 to 50 grams per liter of the ready-to-use developer composition.

Such developing agents can be used alone or in combination with auxiliary developing agents which show a superadditive affect, such as p-aminophenol and substituted p-aminophenol (e.g. N-methyl-p-aminophenol (known as metol) and 2,4-diaminophenol) and pyrazolidones (e.g. 1-phen-yl-3-pyrazolidone or phenidone) and substituted pyrazolidones (e.g., 4-methyl-1-phenyl-3-pyrazolidone, 4-hydroxymethyl-4-me-thyl-1-phenyl-3-pirazolidone (known as dimezone S), and 4,4'-di-methyl-1-phenyl-3-pyrazolidone (known as dimezone). These auxiliary developing agents are generally used in an amount from about 0.1 to 10, preferably 0.5 to 5 grams per liter of ready-to-use developer composition.

The antifogging agents, known in the art to eliminate fog on the developed photographic silver halide films, include derivatives of benzimidazole, benzotriazole, tetrazole, indazole, thiazole, etc. Preferably, the developer comprises a combination of benzotriazole-, indazole- and mercaptoazole-type antifoggants, more preferably a combination of 5-methylbenzotriazole, 5-nitro-indazole and 1-phenyl-5-mercaptotetrazole. Other examples of mercaptoazoles are described in U.S. Pat. No. 3,576,633, and other examples of indazole type antifoggants are described in U.S. Pat. No. 2,271,229. More preferably, particular mixtures of these antifogging agents are useful to assure low fog levels; such preferred mixtures include mixtures of 5-nitroindazole and benzimidazole nitrate, 5-nitrobenzotriazole and 1-phenyl-1-H-tetrazole-5-thiol and 5-methylbenzotriazole and 1-phenyl-1H-tetrazole-5-thiol. The most preferred combination is 5-methylbenzotriazole and 1-phenyl-1-H-tetrazole-5-thiol. These mixtures are used in a total amount of from about 0.01 to 5, preferably 0.02 to 3 grams per liter of the ready-to-use developer composition. Of course optimum quantities of each compound and proportion can be found by the skilled in the art to respond to specific technical needs. In particular, 5-methylbenzotriazoles have been found to give the best results when used in mixture with 1-phenyl-1-H-tetrazole-5-thiol, the latter being present in minor amount with respect to the weight of the total mixture, in a percent of less than 20%, preferably less than 10%.

The developer, comprising said antifoggant combination, is advantageously used in a continuous transport processing machine at high temperature processing (higher than 30° C.) for processing of X-ray elements without changes in the sensitometric properties of the element, mainly without a substantial increase of the fog of the developed element.

The sequestering agents are known in the art such as, for example, aminopolycarboxylic acids (ethylenediaminotetraacetic acid, diethylenetriamine-pentaacetic acid, nitrilotriacetic acid, diaminopropanol-tetraacetic acid, etc.), aminopolyphosphonic acids (methylaminophosphonic acid, phosphonic acids described in Research Disclosure 18837 of December 1979, phosphonic acids described in US Pat. No. 4,596,764, etc.), cyclicaminomethane diphosphonic acids (as described in EP Appl. No. 286,874), polyphosphate compounds (sodium hexametaphosphate, etc.), a-hydroxycarboxylic acid compounds (lactic acid, tartaric acid, etc.), dicarboxylic acid compounds (malonic acid, etc.), a-ketocarboxylic acid compounds as disclosed in U.S. Pat. No. 4,756,997 (pyruvic acid, etc.), alkanolamine compounds (diethanolamine, etc.), etc.

The above sequestering agents can be used alone or in combination each other. More preferably, particular mixtures of these sequestering agents are useful to assure strong resistance to air oxidation; such preferred mixtures include mixtures of aminopolycarboxylic acids and cyclicaminomethane diphosphonic acids as disclosed in EP 446,457. Said sequestering agents can be advantageously used in a total amounts of from about 1 to about 60 grams per liter, preferably of from about 2 to about 30 grams per liter of ready-to-use developer. Of course optimum quantities of each compound and proportion can be found by the skilled in the art to respond to specific technical needs. The sequestering agents have been found to increase the stability of the developer over a long period of time.

The term "sulfite antioxidant", represents those compounds known in the art as capable of generating sulfite ions ($SO_3$—) in aqueous solutions and include sulfites, bisulfites, metabisulfites (1 mole of metabisulfite forming 2 moles of bisulfite in aqueous solution). Examples of sulfites, bisulfites, and metabisulfites include sodium sulfite, sodium bisulfite, sodium metalisulfite, potassium sulfite, potassium bisulfite, potassium metabisulfite and ammonium metabisulfite. The amount of the total sulfite ions is preferably not less than 0.05 moles, more preferably 0.1 to 1.25 moles, and most preferably 0.3 to 0.9 moles, per liter of developer. The amount of the sulfite ions with respect to the hydroquinone preferably exceeds a molar ratio of 2.5:1 and. more preferably, is between 2.5:1 to 4:1.

The developer can further include a buffer (e.g., carbonic acid salts, phosphoric acid salts, polyphosphates, metaborates, boric acid and boric acid salts). Preferably, the developer does not comprise boric acid and/or boric acid salts. The amount of the buffer with respect to the sulfite preferably exceeds a molar ratio of 0.5:1 and, more preferably, is between 1:1 to 2:1.

The developer can further comprise silver halide solvents. Useful silver halides solvents are solutions or compounds well known in the art, such as soluble halide salts, (e.g., NaBr, KCl), thiosulfates (e.g. sodium thiosulfate, potassium thiosulfate and ammonium thiosulfate), sulfites (e.g., sodium sulfite), ammonium salts (e.g. ammonium chloride), thiocyanates (e.g., potassium thiocyanate, sodium thiocyanate, ammonium thiocyanate), thiourea, imidazole compounds (e.g., 2-methylimidazole as described in U.S. Pat. No. 3,708,299) and thioether compounds.

In a preferred embodiment the radiographic developer can comprise thiosulfates and thiocyanates, alone or in combination with each other. In a more preferred embodiment the radiographic developer comprises alkali metal or ammonium thiosulfates or thiocyanates, alone or in combination with each other. The amount of the silver halide solvent used varies depending on the type of the silver halide solvent. The total amount of the silver halide solvents is generally in the range of from 0.01 to 50 mMoles per liter, more preferably in the range of from 0.1 to 30 mMoles per liter of ready-to-use developer composition.

In the developer composition there are used inorganic alkaline agents to obtain the preferred pH which is usually higher than 10. inorganic alkaline agents include KOH, NaOH, LiOH, sodium and potassium carbonate, etc.

Other adjuvants well known to the skilled in the art of developer formulation may be added to the developer. These include restrainers, such as the soluble halides (e.g., KBr), solvents (e.g., polyethylene glycols and esters thereof), development accelerators (e.g., polyethylene glycols and pyrimidinium compounds), preservatives, surface active agents, and the like.

The developer is prepared by dissolving the ingredients in water and adjusting the pH to the desired value. The pH value of the developer is in the range Of from 9 to 12, more preferably of from 10 to 11. The developer may also be prepared in a single concentrated form and then diluted to a working strength just prior to use. The developer may also be prepared in two or more concentrated parts to be combined and diluted with water to the desired strength and placed in the developing tank of the automatic processing machine.

The second unit is the fixing unit and preferably the fixing bath is a hardener free fixing bath comprising:

(1) at least one fixing agent, (2) at least one acid compound, (3) at least one buffering agent.

The fixing agents for silver halide radiographic elements include thiosulfates, such as ammonium thiosulfate, sodium thiosulfate, potassium thiosulfate; thiocyanates, such as am-monium thiocyanate, sodium thiocyanates; sulfites, such as sodium sulfite, potassium sulfite; ammonium salts, such as ammonium bromide, ammonium chloride; and the like.

Acid compounds are sodium or potassium metabisulfates, boric acid, acetic acid, and the like.

The fixing solution further includes a buffer (e.g., carbonic acid salts, phosphoric acid salts, polyphosphates, metaborates, boric acid and boric acid salts, acetic acid and acetic acid salts, and the like).

Other components usually employed in fixing bath are disclosed, for example, in L.F.A. Mason, "Photographic Processing Chemistry", pp. 179–195, Focal Press Ltd., and in D.H.O. John, "Radiographic Processing", pp. 152–178, Focal Press Ltd., London.

In a preferred embodiment the fixing solution does not comprise boric acid and/or boric acid salts. The aim of boric acid is substantially related to its binding properties relative to the aluminum ion (used as gelatin hardener in conventional fixing solutions). If the aluminum is bonded by boric acid, the formation of any gels due to $Al(OH)_3$ is avoided. In the absence of gelatin hardeners containing aluminum, boric acid and/or derivatives thereof can be omitted from the fixing solution, so obtaining a less polluting solution.

The following examples are intended to better explain the present invention, which however cannot be considered limited thereto.

EXAMPLE 1

SCREENS

The following intensifying screens were employed:

SCREEN I

This screen has a composition and structure corresponding to that of the commercial Trimax TM T1 screen, a high resolution screen manufactured by 3M Company. It consists of a terbium activated gadolinium oxysulfide phosphor having an average particle size of 3.5 μm coated in a hydrophobic polymer binder at a phosphor coverage of 260 g/m$^2$ and a thickness of 67 μm on a polyester support. Between the phosphor layer and the support a reflective layer of $TiO_2$ particles in a polyurethane binder was coated. The screen was overcoated with a cellulose triacetate layer.

SCREEN II

This screen has a composition and structure corresponding to that of the commercial Trimax TM T6 screen, a medium resolution screen manufactured by 3M Company. It consists of a terbium activated gadolinium oxysulfide phosphor having an average particle size of 3.5 μm coated in a hydrophobic polymer binder at a phosphor coverage of 500 g/m$^2$ and a thickness of 139 μm on a polyester support. Between the phosphor layer and the support a reflective layer of $TiO_2$ particles in a polyurethane binder was coated. The screen was overcoated with a cellulose triacetate layer.

SCREEN III

This screen has a composition and structure corresponding to that of the commercial Trimax TM T16 screen, a high speed screen manufactured by 3M Company. It consists of a terbium activated gadolinium oxysulfide phosphor having an average particle size of 5.5 μm coated in a hydrophobic polymer binder at a phosphor coverage of 1050 g/m$^2$ and a thickness of 250 μm on a polyester support. Between the phosphor layer and the support a reflective layer of $TiO_2$ particles in a polyurethane binder was coated. The screen was overcoated with a cellulose triacetate layer.

SCREEN EMISSION

The relative green emission of the above screens is:

Screen I:100

Screen II:400

Screen III:1000

The above results were obtained exposing each screen to a tungsten target X-ray tube operated at 80 kVp and 25 mA. The X-ray emission passed through an aluminum step wedge before reaching the screen.

Actual emission levels were converted to relative emission levels by dividing the emission of each screen by the emission of Screen I and multiplying by 100. Screen II, having an emission four times higher than screen I, showed an emission difference of 0.6 IogE.

SILVER HALIDE EMULSIONS

The following silver halide emulsions were prepared:

HC EMULSION

A high contrast (HC) silver halide emulsion comprising tabular silver bromide grains having a thickness lower than 0.4 μm and an aspect ratio lower than 8:1 was prepared in the presence of a deionized gelatin. The obtained emulsion was sensitized to green light with a cyanine dye and chemically sensitized with sodium p-toluenethiosulfonate, sodium p-toluene-sulfinate and benzothiazoleiodoethylate.

LC EMULSION

A low contrast (LC) silver halide emulsion was prepared by mixing seven pads of the above described HC emulsion, two parts of a cubic silver bromoiodide emulsion comprising 1.7% tool of iodide and having an average diameter of 0.4 μm, and one pad of a octahedral silver bromoiodide emulsion comprising 2.3% mol of iodide and having an average diameter of 0.7 μm. The obtained emulsion was sensitized to green light with a cyanine dye and chemically sensitized with sodium p-toluene-thiosulfonate, sodium p-toluenesulfinate and benzothiazoleiodoethylate.

VLC EMULSION

A very low contrast (VLC) silver halide emulsion was prepared by mixing 35 pads of a cubic silver bromoiodide emulsion comprising 2.3% mol of iodide and having an average diameter of 1.3 μm, 20 pads of a octahedral silver chlorobromoiodide emulsion comprising 1.2% mol of iodide and 14.4% mol of chloride having an average diameter of 0.7 μm, 10 pads of a cubic silver bromoiodide emulsion comprising 1.7% mol of iodide and having an average diameter of 0.4 μm, and 35 pads of a octahedral silver bromoiodide emulsion comprising 2.3% mol of iodide and having an average diameter of 0.7 μm. The obtained emulsion was sensitized to green light with a cyanine dye and chemically sensitized with sodium p-toluenthiosulfonate, sodium p-toluensulfinate and benzothiazoleiodoethylate.

EMULSION SENSITOMETRY

Each of the above emulsions was coated at pH=6.7 on both side of a blue tinted polyester film support at a silver coverage of 2.1, 2.1 and 2.5 g/m$^2$, respectively, and a gelatin coverage of 2.85 g/m$^2$ per side. Before coating the emulsion, 3.5% by weight (relative to gelatin) of the 1,3-bis-vinyl-sulfonyl-2-propanol hardener was added. A non deionized gelatin overcoat comprising 0.9 g/m$^2$ of gelatin per side and 2% of the above hardener was applied on each coating at pH=6.7. The films in the form of sheets were stored for 15 hours at 50° C., exposed to white light and processed in a 3M Trimatic$^{TM}$ XP515 automatic processor using a 3M XAD2 developer and 3M XAF2 fixer.

The results are summarized in the following table 1.

TABLE 1

| Emulsion | HC | LC | VLC |
|---|---|---|---|
| D.min | 0.20 | 0.20 | 0.20 |
| D.max | 3.70 | 3.30 | 2.80 |
| Speed | 2.30 | 2.30 | 2.45 |
| Average contrast | 2.55 | 2.05 | 1.50 |
| Shoulder contrast | 3.30 | 1.90 | 1.10 |
| Toe contrast | 39 | 44 | 52 |
| Melting time | 65' | 68' | 9' |
| Swelling index | 106% | 110% | 178% |

RADIOGRAPHIC ELEMENTS

A set of double side radiographic elements were prepared by coating the above described emulsions on a blue tinted polyester film support according the following scheme:

| | Front | | Back |
|---|---|---|---|
| FILM I | LC | // | LC |
| FILM II | LC | // | HC |
| FILM III | HC | // | LC |
| FILM IV | HC | // | VLC |

Films II and III are simply reversed, but their composition is identical. The coating method, additives and procedures were the same as described above.

ASSEMBLIES

A set of radiographic assemblies were prepared employing the above described screens and radiographic elements according the following scheme. As a comparison, the example Element E described in U.S. Pat. No. 4,994,355 (Film V) having different speed and contrast and means to reduce cross-over is also used. (c) represents a comparison and (i) represents a system of the invention.

| Assembly | Front screen | Film | Back screen |
|---|---|---|---|
| A (c) | II | I | II |
| B (i) | I | II | III |
| C (c) | II | III | II |
| E (c) | I | V | III |
| F (i) | I | IV | III |
| G (i) | I | III | III |
| H (i) | III | II | I |

The above described assemblies were exposed to X-rays from a tungsten target tube operated at 80 kVp and 25 mA from a distance of 120 cm. The X-rays passed through an aluminum step wedge before reaching the assembly. Following exposure the films were processed in a 3M Trimatic TM P515 processor at a total processing time of 90 seconds using a 3M XAD2 developer and 3M XAF2 fixer.

The sensitometric results are summarized in the following table 2.

TABLE 2

| Assembly | D.min | D.max | Speed | Average contrast | Shoulder contrast | Toe contrast |
|---|---|---|---|---|---|---|
| A (c) | 0.22 | 3.10 | 2.21 | 1.90 | 1.60 | 44 |
| B (i) | 0.21 | 3.50 | 2.30 | 2.10 | 2.50 | 50 |
| C (c) | 0.21 | 3.50 | 2.21 | 2.30 | 2.90 | 46 |
| E (c) | 0.31 | 3.70 | 2.20 | 1.35 | 2.20 | 58 |
| F (i) | 0.20 | 3.60 | 2.30 | 1.60 | 2.70 | 70 |
| G (i) | 0.21 | 3.50 | 2.28 | 2.05 | 2.60 | 51 |
| H (i) | 0.21 | 3.50 | 2.32 | 2.00 | 2.50 | 54 |

The data of table 2 show the improvement of the present invention. In particular it is worth noting that assemblies B and G show practically the same results, although the radiographic element was reversed.

Crossover of the above described assemblies was measured according to the following formula at different optical densities, to provide an estimation of the image quality relative to each area.

$$A = \left(\left(\left(\frac{XF}{B+XF}\right)\left(\frac{B}{S}\right)\right)+\left(\left(\frac{XB}{F+XB}\right)\left(\frac{F}{S}\right)\right)\right) * 100$$

wherein A is the imagewise cross-over percentage, B is the optical density of the back silver halide emulsion layer, F is the optical density of the front silver halide emulsion layer, XB is the optical density due to cross-over from the back side on the front side, XF is the optical density due to cross-over from the front side on the back side, and S is the sum of B+F+XB+XF.

The A values are summarized in the following table 3:

TABLE 3

| Optical Density | Assembly A | Assembly B | Assembly E | Assembly G | Assembly H |
|---|---|---|---|---|---|
| 0.50 | 0 | — | — | — | — |
| 0.75 | 5 | 0 | — | 2 | — |
| 1.00 | 10 | 0 | — | 3 | — |
| 1.25 | 11 | 2 | 0 | 4 | 0 |
| 1.50 | 13 | 3 | 0 | 5 | 0 |
| 1.75 | 15 | 3 | 0 | 5 | 1 |
| 2.00 | 18 | 5 | 0 | 7 | 1 |
| 2.25 | 21 | 5 | 0 | 9 | 2 |

TABLE 3-continued

| Optical Density | Assembly A | Assembly B | Assembly E | Assembly G | Assembly H |
|---|---|---|---|---|---|
| 2.50 | 22 | 6 | 0 | 12 | 3 |
| 2.75 | 24 | 8 | 1 | 14 | 6 |
| 3.00 | 25 | 10 | 1 | 20 | 12 |
| 3.25 | 25 | 13 | 3 | 25 | 23 |
| Average | | | | | |
| 0.50–1.75 | 9 | 1.4 | 1 | 3 | 1 |
| 1.75–3.25 | 22 | 8 | 1 | 14.5 | 8 |

The following tables 4 and 5 show the results of a practical evaluation in terms of physical properties and image quality obtained with the above assemblies. The results are expressed in terms of scholastic score, wherein 8 is "very good", 7 is "good", 6 is "sufficient", 5 is "insufficient" and 4 is "inadequate". Each score of tables 4 and 5 represents the mathematical average of an evaluation test conducted by three technical people.

TABLE 4

| Assembly | Graininess | Tint | Tone | Short processing Cycle Develop. | Drying | Tint | Tone |
|---|---|---|---|---|---|---|---|
| A | 7 | 7 | 7 | 8 | 8 | 7 | 7 |
| B | 8 | 7 | 7 | 7 | 7 | 7 | 7 |
| C | 7 | 7 | 7 | 8 | 8 | 7 | 7 |
| E | 6 | 5 | 5 | 6 | 6 | 4 | 4 |
| F | 8 | 7 | 7 | 7 | 7 | 7 | 7 |
| G | 8 | 7 | 7 | 7 | 7 | 7 | 7 |
| H | 8 | 7 | 7 | 7 | 7 | 7 | 7 |

TABLE 5

| Assembly | Lung | Heart | Bone | Low Density Tissues | Mediastinum Area | Global |
|---|---|---|---|---|---|---|
| A | 7 | 6 | 7 | 6 | 6 | 6 |
| B | 7 | 7 | 7 | 6–7 | 7 | 7 |
| C | 7 | 6 | 7 | 6 | 5 | 6 |
| E | 5 | 8 | 6 | 8 | 8 | 7 |
| F | 7 | 7 | 7 | 7 | 7 | 7 |
| G | 7 | 7 | 7 | 6–7 | 7 | 7 |
| H | 7 | 7 | 6 | 6–7 | 7 | 7 |

The short processing cycle was performed in a 3M Trimatic TM XP515 automatic processor at a total processing time of about 30 seconds and with I0 developing and fixing solutions not comprising hardeners. Sensitometric results were similar to those of Table 2.

The data of tables 4 and 5 indicate that only the assemblies B, F, G, and H, satisfying all the requirements of the present invention, have the good image qualities, physical properties and developability to be processed in a short processing time of less than 45 seconds. It is worth noting that assemblies B and G show the same results, although the radiographic element was reversed during exposure.

We claim:

1. A radiographic assembly comprising:

a radiographic element which comprises a support and a front and back pair of silver halide emulsion layers coated on the opposite sides of the support, and a front and back pair of intensifying screens adjacent said front and back emulsion layers, respectively, wherein at least one of said silver halide emulsion layers shows a swelling index lower than 140% and a melting time of from 45 to 120 minutes, and the contrast difference between said pair of silver halide emulsion layers is at least 0.5, wherein the X-ray stimulated light emission difference between said pair of intensifying screens is at least 0.6 IogE, and wherein the average imagewise cross-over of said radiographic element is lower than 5% at optical density of from 0.5 to 1.75 and in the range of from 5 to 15% at optical density of from 1.75 to 3.25, said imagewise cross-over being measured according to the following formula:

$$A = \left(\left(\left(\frac{XF}{B+XF}\right)\left(\frac{B}{S}\right)\right)+\left(\left(\frac{XB}{F+XB}\right)\left(\frac{F}{S}\right)\right)\right)*100$$

wherein A is the imagewise cross-over percentage, B is the optical density of the back silver halide emulsion layer, F is the optical density of the front silver halide emulsion layer, XB is the optical density due to cross-over from the back side on the front side, XF is the optical density due to cross-over from the front side on the back side, and S is the sum of B+F+XB+XF.

2. The radiographic assembly according to claim I wherein the contrast of said back silver halide emulsion layer is at least 0.5 unit lower than the contrast of said front silver halide emulsion layer, and wherein the X-ray stimulated light emission of said back intensifying screen is at least 0.6 IogE higher than the X-ray stimulated light emission of said front intensifying screen.

3. The radiographic assembly according to claim 1 wherein the contrast of said front silver halide emulsion layer is at least 0.5 unit lower than the contrast of said back silver halide emulsion layer, and wherein the X-ray stimulated light emission of said back intensifying screen is at least 0.6 IogE higher than the X-ray stimulated light emission of said front intensifying screen.

4. The radiographic assembly according to claim 1 wherein said contrast difference between said pair of silver halide emulsion layers is at least 0.8.

5. The radiographic assembly according to claim 1 wherein said X-ray stimulated light emission difference between said pair of intensifying screens is at least 0.9 IogE.

6. The radiographic assembly according to claim 1 wherein said average imagewise cross-over of said radiographic element is lower than 3% at optical density of from 0.5 to 1.75 and in the range of from 5 to 10% at optical density of from 1.75 to 3.25.

7. The radiographic assembly according to claim 1 wherein both said front and back silver halide emulsion layers show a swelling index lower than 140% and a melting time of from 45 to 120 minutes.

8. The radiographic assembly according to claim 1 wherein said silver halide emulsion layers comprise at least one silver halide emulsion selected in the group consisting of cubic silver halide emulsions, octahedron silver halide emulsions, tetradecahedron silver halide emulsions and tabular silver halide emulsions.

9. The radiographic assembly according to claim 8 wherein said tabular silver halide emulsion comprises at least 15%, relative to the total projected area, of tabular grains having an aspect ratio higher than 3:1 and a thickness lower than 0.4 μm.

10. The radiographic assembly according to claim 8 wherein said tabular silver halide emulsion comprises at least 25%, relative to the total projected area, of tabular grains having an aspect ratio of from 3:1 to 20:1 and a thickness lower than 0.3 μm.

11. The radiographic assembly according to claim 1, wherein said silver halide emulsion layers are coated on the support at a total silver coverage of at least 1 $g/m^2$.

12. The radiographic assembly according to claim 1 wherein said radiographic element comprises at least a hydrophilic colloid layer comprising highly deionized gelatin having less than 50 ppm of $Ca^{++}$ and less than 5 ppm of anions.

13. The radiographic assembly according to claim 12 wherein said hydrophilic colloid layer is at least one of said silver halide emulsion layers.

14. The radiographic assembly according to claim 12 wherein at least 50% of the total hydrophilic colloid of said radiographic element consists of highly deionized gelatin.

15. The radiographic assembly according to claim 12 wherein at least one of said hydrophilic colloid layers comprises a bi-,tri-, or tetra-vinylsulfonyl substituted organic hydroxy compound.

16. The radiographic assembly according to claim 15 wherein said bi-,tri-, or tetra-vinylsulfonyl substituted organic hydroxy compound has the following formula:

$$(CH_2{=}CH{-}SO_2{-})_n{-}A,$$

wherein A is an n-valent organic group containing at least one hydroxy group and n is 2,3 or 4.

17. The radiographic assembly according to claim 16 wherein the group A represents a n-valent acyclic hydrocarbon group, 5 or 6 membered hetero cyclic group containing at least one of nitrogen, an oxygen or a sulfur atom, 5 or 6 membered alicyclic group or aralkylene group having at least 7 carbon atoms.

18. The radiographic assembly according to claim 16, wherein n is 2 and the group A is a divalent acyclic hydrocarbon group having 1 to 8 carbon atoms, or an aralkylene group having a total of 8 to 10 carbon atoms.

19. The radiographic assembly according to claim 15, wherein said bi-,tri-, or tetra-vinylsulfonyl substituted organic hydroxy compound is used in an amount of from 0.5 to 10% by weight of said hydrophilic colloid.

* * * * *

UNITED STATES PATENT AND TRADEMARK OFFICE

CERTIFICATE OF CORRECTION

PATENT NO.: 5,354,648

DATED: October 11, 1994

INVENTOR(S): Bucci et al.

It is certified that error appears in the above-identified patent and that said Letters Patent is hereby corrected as shown below:

Column 1, lines 39-40, delete "Erosworth" and insert --Emsworth--.

Column 3, line 34, delete "ıogE" and insert --logE--.

Column 4, line 3, delete "ıogE" and insert --logE--.

Column 4, line 59, delete the word "lo".

Column 10, line 32, delete the number "35".

Column 18, line 59, delete "pads" and insert --parts--.

Column 19, line 4, delete "pads" and insert --parts--.

UNITED STATES PATENT AND TRADEMARK OFFICE

CERTIFICATE OF CORRECTION

PATENT NO.: 5,354,648

DATED: October 11, 1994

INVENTOR(S): Bucci et al.

It is certified that error appears in the above-identified patent and that said Letters Patent is hereby corrected as shown below:

Column 19, line 6, delete "pads" and insert --parts--.

Column 19, line 9, delete "pads" and insert --parts--.

Column 19, line 12, delete "pads" and insert --parts--.

Signed and Sealed this

Twenty-eighth Day of May, 1996

*Attest:*

BRUCE LEHMAN

*Attesting Officer*

*Commissioner of Patents and Trademarks*